US011015378B2

(12) United States Patent
Fees et al.

(10) Patent No.: US 11,015,378 B2
(45) Date of Patent: May 25, 2021

(54) SPINDLE DRIVE

(71) Applicant: Brose Fahrzeugteile GmbH & Co. Kommanditgesellschaft, Bamberg, Bamberg (DE)

(72) Inventors: Heiner Fees, Bietigheim-Bissingen (DE); Dominik Hahne, Anroechte-Robringhausen (DE); Ulrich Hohl, Heilbronn (DE); Harald Krueger, Bamberg (DE); Andreas Ryf, Herzogenbuchsee (CH)

(73) Assignee: Brose Fahrzeugteile GmbH SE & Co. Kommanditgesellschaft, Bamberg, Bamberg (DE)

( * ) Notice: Subject to any disclaimer, the term of this patent is extended or adjusted under 35 U.S.C. 154(b) by 0 days.

(21) Appl. No.: 15/775,596

(22) PCT Filed: Nov. 11, 2016

(86) PCT No.: PCT/EP2016/077470
§ 371 (c)(1),
(2) Date: May 11, 2018

(87) PCT Pub. No.: WO2017/081277
PCT Pub. Date: May 18, 2017

(65) Prior Publication Data

US 2018/0371821 A1 Dec. 27, 2018

(30) Foreign Application Priority Data

Nov. 11, 2015 (DE) ..... 10 2015 119 457.0

(51) Int. Cl.
*E05F 15/622* (2015.01)
*E05F 1/10* (2006.01)
*E05F 5/00* (2017.01)

(52) U.S. Cl.
CPC ..... *E05F 15/622* (2015.01); *E05F 1/1058* (2013.01); *E05F 5/00* (2013.01); *E05Y 2201/21* (2013.01); *E05Y 2900/546* (2013.01)

(58) Field of Classification Search
CPC ..... E05F 15/622; E05F 15/41; E05F 15/603; E05Y 2201/21; E05Y 2900/546
See application file for complete search history.

(56) References Cited

U.S. PATENT DOCUMENTS 5,913,763 A * 6/1999 Beran ..... E05F 3/102 49/506
6,877,791 B2 * 4/2005 Greuel ..... E05F 15/622 296/146.1

(Continued)

FOREIGN PATENT DOCUMENTS

DE 202008016929 5/2010
DE 102010019344 5/2011

(Continued)

OTHER PUBLICATIONS

"International Search Report and Written Opinion," for PCT Application No. PCT/EP2016/077470, priority application to U.S. Appl. No. 15/775,596 dated Feb. 10, 2017 (17 pages) with English translation.

(Continued)

*Primary Examiner* — Justin B Rephann
(74) *Attorney, Agent, or Firm* — Pauly, DeVries Smith & Deffner LLC

(57) ABSTRACT

The disclosure relates to a spindle drive for a tailgate of a vehicle which can be adjusted between two drive end positions, in particular between a retracted position and an extended position, two drive connections being provided for diverting drive movements and a drive train between the drive connections, the drive train comprising a motor unit and a drive worm gear downstream of the motor unit in drive (Continued)

terms, the drive worm gear having a spindle with an external spindle drive and a spindle nut with an internal spindle nut thread which is in screw engagement with the external spindle thread, a brake assembly being provided for braking at least a part of the drive train of the spindle drive. The brake assembly can be adjustable in relation to its braking action and that the brake assembly is coupled for adjustment thereof with a component of the drive train.

24 Claims, 8 Drawing Sheets

(56) References Cited

U.S. PATENT DOCUMENTS

| | | | | |
|---|---|---|---|---|
| 7,634,951 | B2 * | 12/2009 | Frieb-Preis | E05F 15/622 74/89.35 |
| 8,042,301 | B2 * | 10/2011 | Ritter | E05F 5/00 49/343 |
| 8,508,170 | B2 * | 8/2013 | Bochen | E05F 15/622 318/266 |
| 9,021,905 | B2 * | 5/2015 | Reif | B60J 5/101 74/89.39 |
| 9,097,056 | B2 * | 8/2015 | Kummer | E05F 15/622 |
| 9,353,836 | B2 * | 5/2016 | Anheier | F16H 25/20 |
| 10,094,159 | B2 * | 10/2018 | Grudzinski | E05F 15/616 |
| 10,180,025 | B2 * | 1/2019 | Conner | E05F 15/622 |
| 10,180,169 | B2 * | 1/2019 | Strobel | F16D 63/002 |
| 10,208,844 | B2 * | 2/2019 | Ritter | F16D 51/02 |
| 10,273,737 | B2 * | 4/2019 | Muller | F16H 25/2454 |
| 10,280,674 | B2 * | 5/2019 | Leonard | E05F 15/622 |
| 2004/0097318 | A1 * | 5/2004 | Greuel | F16D 65/06 475/149 |
| 2004/0113456 | A1 * | 6/2004 | Greuel | E05F 15/622 296/146.8 |
| 2007/0289397 | A1 * | 12/2007 | Ritter | E05F 5/00 74/22 A |
| 2008/0020893 | A1 * | 1/2008 | Frieb-Preis | F16H 25/20 476/64 |
| 2011/0271776 | A1 * | 11/2011 | Reif | F16H 25/2454 74/25 |
| 2011/0290050 | A1 * | 12/2011 | Kummer | E05F 15/622 74/89.37 |
| 2014/0000394 | A1 * | 1/2014 | Anheier | F16H 25/20 74/89.29 |
| 2014/0224045 | A1 * | 8/2014 | Kummer | E05F 15/622 74/60 |
| 2015/0155757 | A1 | 6/2015 | Hidaka et al. | |
| 2015/0300468 | A1 * | 10/2015 | Ritter | F16H 25/2454 74/89.39 |
| 2016/0177612 | A1 * | 6/2016 | Buchheim | E05F 5/025 296/50 |
| 2017/0248183 | A1 * | 8/2017 | Strobel | F16D 63/002 |
| 2017/0342758 | A1 * | 11/2017 | Grudzinski | E05F 15/616 |
| 2017/0342761 | A1 * | 11/2017 | Conner | E05F 15/622 |
| 2019/0077234 | A1 * | 3/2019 | Yagi | E05F 15/622 |
| 2019/0093408 | A1 * | 3/2019 | Kimura | E05F 15/40 |

FOREIGN PATENT DOCUMENTS

| | | |
|---|---|---|
| DE | 202011106110 | 1/2013 |
| EP | 1840311 | 10/2007 |
| EP | 1940012 | 7/2008 |
| WO | 2017081277 | 5/2017 |

OTHER PUBLICATIONS

"Search Report," for German Patent Application No. 102015119457.0, priority application to U.S. Appl. No. 15/775,596 dated Aug. 29, 2016 (7 pages).

International Preliminary Report on Patentability for PCT Application No. PCT/EP2016/077470, priority application to U.S. Appl. No. 15/775,596 dated May 24, 2018 (14 pages) with English translation.

* cited by examiner a)

b)

a)

b)

SPINDLE DRIVE

CROSS-REFERENCE TO RELATED APPLICATIONS

This application is a national stage application under 35 U.S.C. 371 of International Patent Application Serial No. PCT/EP2016/077470, entitled "Spindle Drive," filed Nov. 11, 2016, which claims priority from German Patent Application No. DE 10 2015 119 457.0, filed Nov. 11, 2015, the disclosure of which is incorporated herein by reference.

FIELD OF THE TECHNOLOGY

The present disclosure relates to a spindle drive for a tailgate of a motor vehicle and also to a tailgate assembly of a motor vehicle.

BACKGROUND

The term "tailgate" should be understood in the broad sense in the present case. It comprises, for example, a tailgate, a trunk lid, an engine hood, a side door, a luggage compartment lid, an elevating roof, or similar, of a motor vehicle. In the following, the scope of application of the motorized adjustment of a tailgate of a motor vehicle is at the fore. This should not be understood as being limiting.

The spindle drive under discussion is not only routinely assigned the function of the motorized adjustment of the tailgate, but also the function of holding the tailgate in the open position and possibly in intermediate positions. For this purpose, the spindle drive under discussion is fitted with a brake assembly which is used for braking at least part of the drive train of the spindle drive and therefore the tailgate.

In a known spindle drive (DE 20 2011 106 110 U1) the brake assembly is only activated when a force emanating from the tailgate is introduced into the spindle drive. An application of force emanating from the drive motor of the spindle drive to the spindle drive otherwise remains unchecked. A coupling arrangement with a mechanism in the manner of a pinch-roll freewheel is provided for this purpose. This arrangement is compact and works reliably. A design simplification would be desirable, however.

A spindle drive with a particularly simple design (DE 20 2008 016 929 U1) shows in one variant a brake arrangement which constantly brakes the drive shaft of the drive motor of the spindle drive. Although this spindle drive exhibits a robust operating performance, the brake assembly is constantly active with its full braking action, which means that it has a disruptive influence in many adjusting ranges of the tailgate. This relates, for example, to a motorized adjustment of the tailgate in the region of the closing position in which unfavorable lever conditions prevent motorized opening and motorized closing in the door seal counter pressures. So that high operational safety can also be guaranteed in the region of the tailgate closing position, the drive motor assigned to the spindle drive must frequently be oversized, which once again results in a structurally complex and therefore cost-intensive design.

SUMMARY

The problem addressed by the disclosure is that of configuring and developing the spindle drive known in the art in such a manner that the design of the spindle drive is optimized from a cost point of view without compromising operational safety.

The above problem is solved in the case of a spindle drive as described herein.

A basic consideration is that the brake assembly should be adjustably configured in relation to its braking action and the brake assembly be coupled for adjustment thereof with a component of the drive train. In the present case, "adjustment of the brake assembly" means that the brake assembly can not only be activated or deactivated, but altered in terms of its intensity.

With the solution as proposed, for example, a continuous adjustment of the braking action of the brake assembly is possible by adjusting the spindle drive. This continuous adjustability means that discontinuity during the motorized opening and closing of the tailgate of the motor vehicle can easily be avoided.

The adjustability of the brake assembly as proposed means that the drive train of the spindle drive can be constantly braked by the brake assembly without having a disruptive influence during the motorized adjustment of the tailgate.

Various embodiments relate to different variants for the adjustment of the braking action of the brake assembly depending on the adjustment of the spindle drive. In an embodiment, the braking action exhibits a kind of hysteresis in relation to the adjustment of the spindle drive, during which the adjustment of the braking action depends, in addition, on the adjustment direction of the spindle drive. This means that the braking action of the brake assembly can be particularly well adjusted to the other mechanical marginal conditions of the tailgate of the motor vehicle.

Various embodiments show particularly robust structural implementation possibilities for the proposed adjustability of the braking action of the brake assembly.

According to some embodiments, the brake element and brake counter-element are an inherent part of a brake package, wherein in one option at least two brake elements and/or at least two brake counter-elements are provided. This means that with a suitable design, a high braking force or a high braking moment can be produced, without excessive preloading of the brake package being required.

Particularly simple adjustability of the brake assembly according to various embodiments refers back to a change in the spring preloading of the brake element and brake counter-element in accordance with various aspects of the disclosure. In this way, an additional possibility for adjusting the braking action through a suitable choice of spring characteristic curves in each case is possible.

According to some embodiments, a particularly high flexibility in the adjustment of the braking action of the brake assembly results from the actuating element of the brake assembly being coupled with a control worm gear which can be adjustable via the drive worm gear. Through a suitable adjustment in the number of screw threads and also the thread pitch of the control worm gears, two other degrees of freedom result for the adjustability of the braking action of the brake assembly as proposed.

Particularly good adjustability of the braking performance can be achieved in that according to various embodiments the brake spring assembly is assigned a first spring component and a second spring component, from which spring forces, in combination, the preloading of the brake package results. The fact that the two spring elements work against one another when it comes to generating the preloading of the spindle drive means that the braking action can be adjusted in principle over a wide range, in particular without this requiring one of the spring components to remain tension-free in order for the braking action to be discontinued. The discontinuation of the braking action itself can be achieved in this way, wherein the spring components are constantly preloaded and therefore positionally defined. The fact that a working point of the two spring components is constantly set which is significantly removed from the tension-free state in each case means that a reproducible braking performance results, even when there are large temperature fluctuations.

In some embodiments, one of the spring components is coupled with the above actuating element in such a manner that the spring component concerned is pre-tensioned depending on the position of the actuating element. This gives rise to the possibility of precise adjustability of the braking method with particularly good reproducibility of the braking performance.

A particularly easily implemented embodiment results in that a spring component of the brake spring assembly is coupled with the spindle nut of the drive worm gear. A control worm gear can be dispensed with to this extent.

In line with other teachings, a tailgate assembly of a motor vehicle with a tailgate and a spindle drive as proposed for the motorized adjustment of the tailgate is disclosed. Reference may be made to all comments regarding the spindle drive as proposed.

Various embodiments provide a spindle drive for a tailgate of a motor vehicle which can be adjusted between two drive end positions, in particular between a retracted position and an extended position, two drive connections being provided for diverting drive movements and a drive train between the drive connections, the drive train comprising a motor unit and a drive worm gear downstream of the motor unit in drive terms, the drive worm gear having a spindle with an external spindle drive and a spindle nut with an internal spindle nut thread which is in screw engagement with the external spindle thread, a brake assembly being provided for braking at least a part of the drive train of the spindle drive, wherein the brake assembly is adjustable in relation to its braking action and the brake assembly is coupled with a component of the drive train for the setting thereof.

In some embodiments, the brake assembly constantly brakes the drive train of the spindle drive.

In some embodiments, the braking action rises or falls with the adjustment of the spindle drive, particularly linearly, at least over a portion of the adjustment range of the spindle drive, wherein the braking action rises at least over a portion of the adjustment range of the spindle drive with the motorized opening of the tailgate and falls at least over a portion of the adjustment range of the spindle drive with the motorized closing of the tailgate.

In some embodiments, the rate of increase and/or the rate of reduction of the braking action relative to the adjustment of the spindle drive is identical for both adjustment directions of the spindle drive and/or wherein the rise and/or fall of the braking action differs depending on the preceding adjustment of the spindle drive and/or on the adjustment direction.

In some embodiments, die brake assembly has an actuating element, the braking action of the brake assembly can be set by an adjustment of the actuating element and the actuating element is coupled with the drive worm gear, in particular with the spindle of the drive worm gear, in such a manner that the braking action rises or falls with the adjustment of the spindle drive at least over a portion of the adjustment range of the spindle drive.

In some embodiments, the brake assembly comprises a brake element and a brake counter-element which are preloaded in respect of one another to generate the braking action via a brake spring assembly and are thereby in frictional engagement with one another.

In some embodiments, the brake element and the brake counter-element are an inherent part of a brake package which is preloaded to generate the braking action via the brake spring assembly, wherein the brake package, in some embodiments, has at least two brake elements and/or at least two brake counter-elements.

In some embodiments, the actuating element is coupled with the brake spring assembly in such a manner that an adjustment of the actuating element accompanies a change in the spring preloading.

In some embodiments, the brake element is coupled with, in particular connected to, a component of the drive train, such as with a drive shaft of the drive train.

In some embodiments, the brake counter-element is coupled with, in particular connected to, a housing component of the spindle drive.

In some embodiments, a control worm gear is provided which has a spindle with an external spindle thread and a spindle nut with an internal spindle nut thread which is in screw engagement with the external spindle thread and wherein the actuating element is coupled with the drive worm gear via the control worm gear, wherein the spindle of the drive worm gear can be coupled with, in particular connected to, the spindle of the control worm gear, and wherein the actuating element is coupled with the spindle nut of the control worm gear or forms the spindle nut of the control worm gear.

In some embodiments, an adjustment of the spindle drive between the two drive end positions accompanies an adjustment of the actuating element between two actuating element end positions.

In some embodiments, the control worm gear comprises at least one freewheel in such a manner that an adjustment of the spindle drive into at least one drive end position results in the control worm gear freewheeling when a freewheel end region upstream of the respective drive end position is passed through, wherein the control worm gear can have two freewheels in such a manner that an adjustment of the spindle drive into the two drive end positions results in each case in the control worm gear freewheeling when a freewheel end region upstream of the respective drive end position is passed through.

In some embodiments, the freewheel is formed in that when a freewheel end region is reached, the spindle nut of the control worm gear comes out of engagement with the spindle thereof, wherein the spindle of the control worm gear can have fewer threads than the spindle of the drive worm gear.

In some embodiments, a spring assembly of the brake assembly is coupled with the actuating element in such a manner that the spring assembly constantly preloads the spindle nut of the control worm gear in engagement with the spindle thereof.

In some embodiments, the brake spring assembly has a first spring component and a second spring component which work against one another, at least over a portion of the adjustment range of the spindle drive, when it comes to generating the preloading of the brake packet, wherein the spring force of the first spring component can help to preload the brake package at least over a portion of the adjustment range of the spindle drive and the spring force of the second spring component reduces the preloading of the brake package.

In some embodiments, the magnitude of the preloading of the brake package results from the difference between the magnitudes of the spring forces of the two spring components.

In some embodiments, the two spring components are arranged along the longitudinal axis of the spindle drive on opposite sides of the brake package.

In some embodiments, both spring components of the brake spring assembly work against one another on one and the same element of the brake spring assembly, in particular on a brake counter-element or a brake counter-element.

In some embodiments, an axial stop is provided for the brake package and the first spring component exerts a spring force on the brake package in the direction of the axial stop, wherein the second spring component can exert a spring force on the brake package against the direction of the axial stop.

In some embodiments, the spring force of the first spring component acting on the brake package is constant, irrespective of the adjustment of the spindle drive, at least over a portion of the adjustment range of the spindle drive.

In some embodiments, a spring component of the brake spring assembly, in particular the second spring component, for adjustment of the braking action is coupled with the actuating element, wherein the brake spring assembly can be in engagement with, or becomes engaged with, the actuating element depending on the adjustment of the spindle drive for setting the braking action.

In some embodiments, a spring component of the brake spring assembly, in particular the second spring component, for adjustment of the braking action is coupled with the spindle nut of the control worm gear, wherein the brake spring assembly can be in engagement with, or becomes engaged with, the spindle nut of the drive worm gear depending on the adjustment of the spindle drive for setting the braking action.

Various embodiments provide a tailgate assembly of a motor vehicle with a tailgate and with a spindle drive for the motorized adjustment of the tailgate as disclosed herein.

BRIEF DESCRIPTION OF THE DRAWINGS

In the following, the teachings of this disclosure are explained in greater detail with the help of drawings depicting various embodiments. In the drawings.

DETAILED DESCRIPTION

Figure 1:
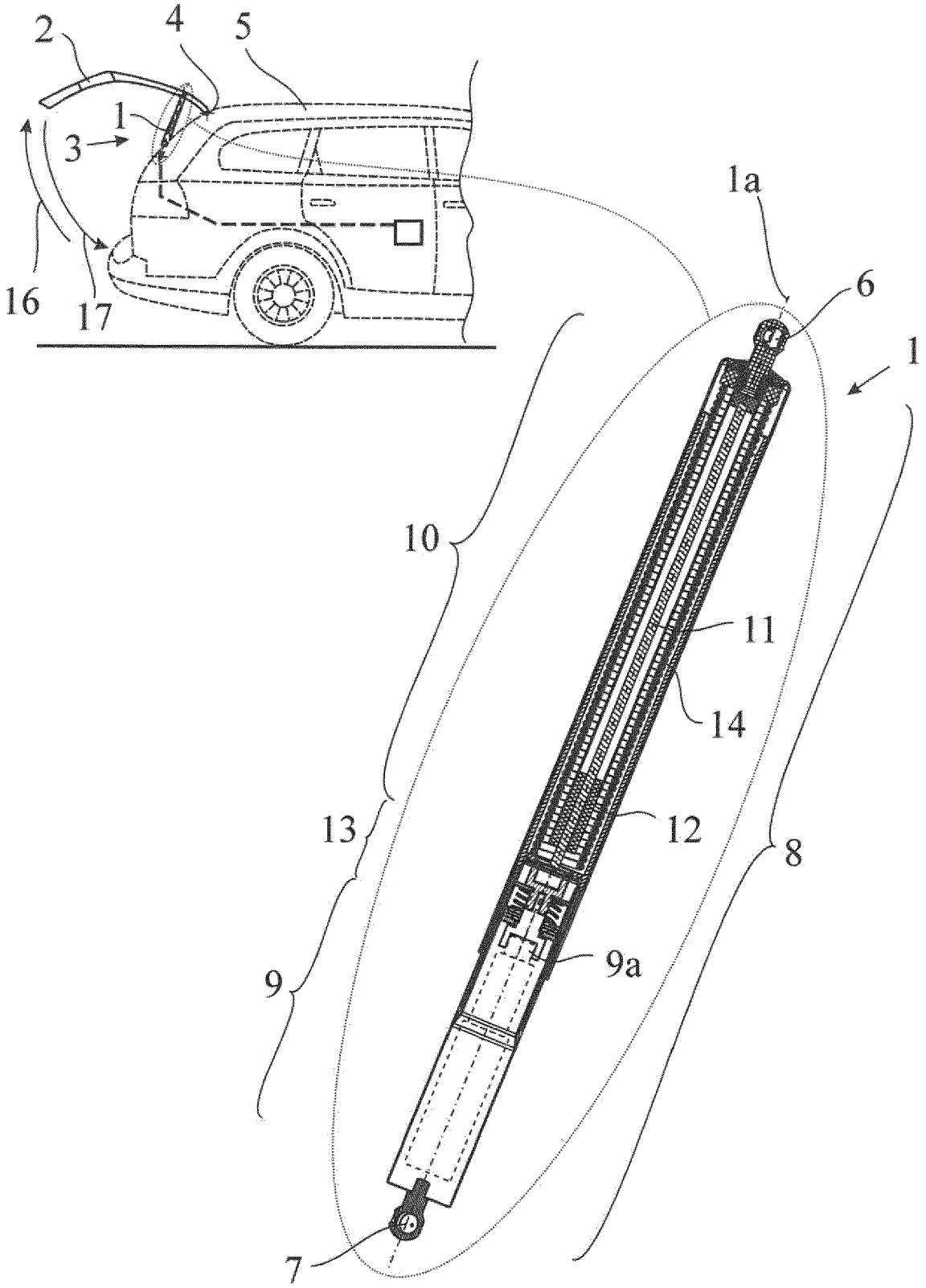
FIG. 1 shows as a schematic side view the tail of a motor vehicle with a spindle drive as proposed.

The spindle drive 1 depicted in drawing is used for the motorized adjustment of a tailgate 2 of a motor vehicle which in this case is configured as a tailgate. Reference may be made to the broad interpretation of the term "tailgate" as mentioned above.

The tailgate 2 is used in a customary manner per se to close a tailgate opening 3. The spindle drive 1 is arranged in this respect to the side of the tailgate opening 3, here in a rain gutter 4 arranged to the side of the tailgate opening 3. Although FIG. 1 only shows a single spindle drive 1, it is provided in this case that a spindle drive 1 is arranged on either side of the tailgate opening 3. The two spindle drives 1 are substantially identical in design structurally speaking.

It can be seen from the representation according to FIG. 1 that the spindle drive 1 depicted there is hinged to the body 5 of the motor vehicle at one end and to the tailgate 2 at the other end.

The spindle drive 1 can be adjusted between two drive end positions which define the adjustment range of the spindle drive 1 in the present case. In turn, different advantageous variants are conceivable for defining the drive end positions. In this case, the drive end positions are positions of the spindle drive 1 which correspond to the open position and the closed position of the tailgate 2 in the mounted state of the spindle drive 1.

The spindle drive 1 is adjustable between a retracted position $S_e$ and an extended position $S_a$ which defines the adjustment range of the spindle drive 1 in the present case. In this case, the retracted position $S_e$ corresponds to the closed position of the tailgate 2, while the extended position $S_a$ corresponds to the open position of the tailgate 2. FIG. 1 shows the tailgate 2 in the open position. In the detail representation shown there, the spindle drive 1 is only shown in the retracted position $S_e$ so that a better overview is provided.

The spindle drive 1 has two drive connections 6, 7 for diverting drive movements and also a drive train 8 between the drive connections 6, 7. The drive train 8 comprises a motor unit 9 and also a drive worm gear 10 downstream of the motor unit 9 in drive terms. Driven by the motor unit 9, the drive worm gear 10 produces the drive movements which are predominantly linear drive movements in the present case.

The drive worm gear 10 is a spindle drive which has a spindle 11 with an external spindle thread and a spindle nut 12 with an internal spindle nut thread which is in screw engagement with the external spindle thread.

The spindle drive 1 is assigned a brake assembly 13 for braking at least part of the drive train 8 of the spindle drive 1. The brake assembly 13 therefore performs a braking action on the part of the drive train 8 concerned. The braking action may be a braking torque or a braking force which acts on any component of the drive train 8. The braking action to be broadly interpreted in accordance with the concept is indicated in FIGS. 3 and 5 using the reference number B.

The brake assembly 13 can be used to hold the tailgate 2 in the open position depicted in FIG. 1, particularly in the event that the spindle drive 1 is switched off. In this case it is provided in this respect that the holding of the tailgate 2 is supported by a spring arrangement 14 which, as depicted in FIG. 1, acts between the two drive connections 6, 7.

The brake assembly 13 is adjustable in respect of the braking action B thereof, wherein the brake assembly 13 is coupled with a component 15 of the drive train 8 for the setting thereof. This means quite generally that the braking action B of the brake assembly 13 can be set by adjusting the appropriate component 15 of the drive train 8. Depending on the structural embodiment of the brake assembly 13, a different braking action B performance can be produced depending on the position S of the spindle drive 1, as can be inferred from the representations according to FIGS. 3 and 5.

Figure 2:
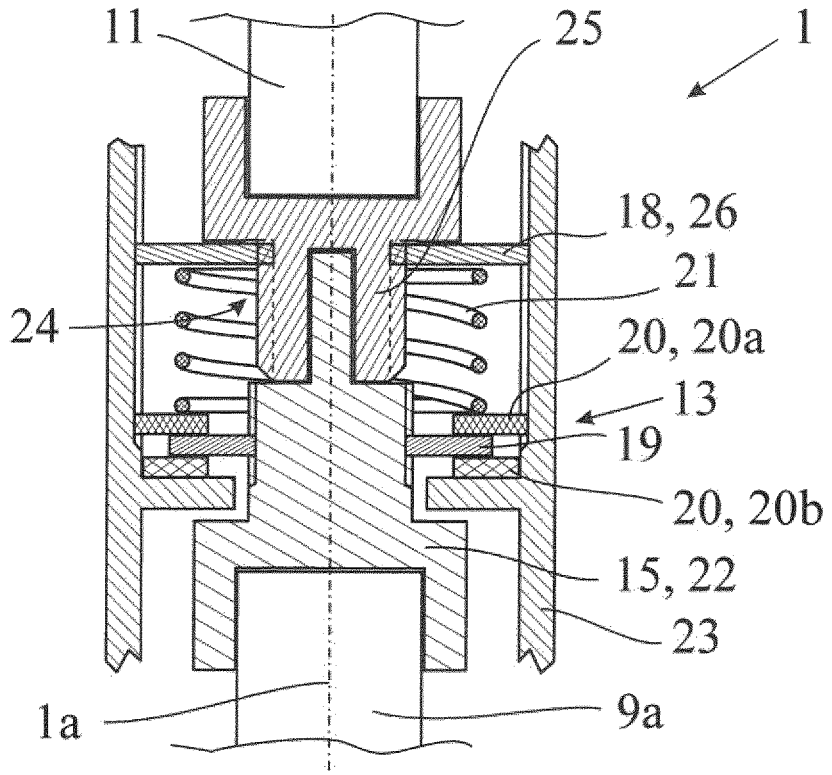
FIG. 2 shows a detail of the spindle drive according to FIG. 1 *a*) relating to the brake assembly with the tailgate in the closed position and *b*) with the tailgate in the open position.
Figure 2:
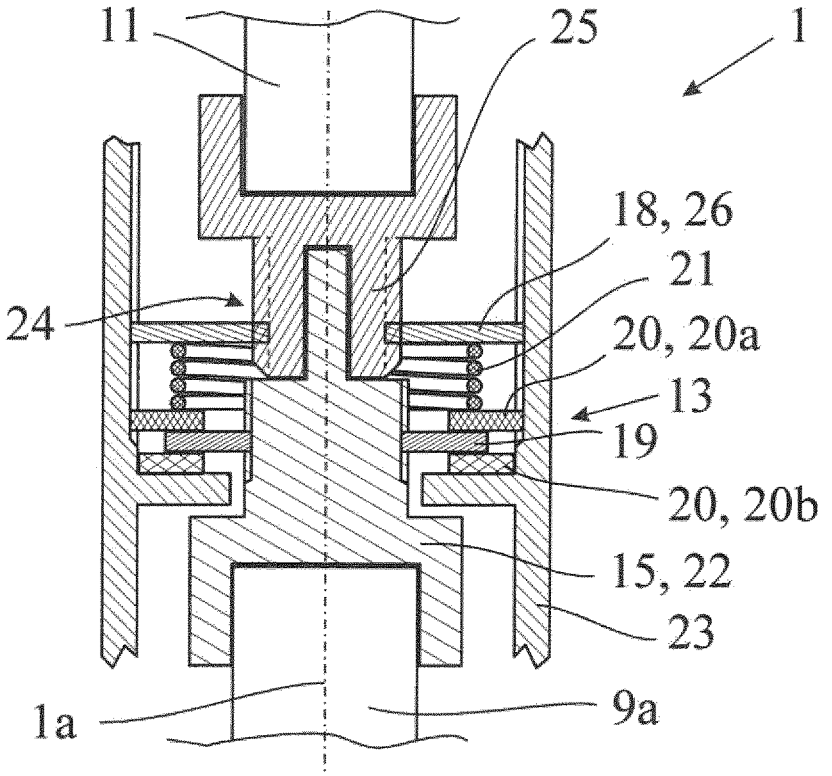
Figure 3:
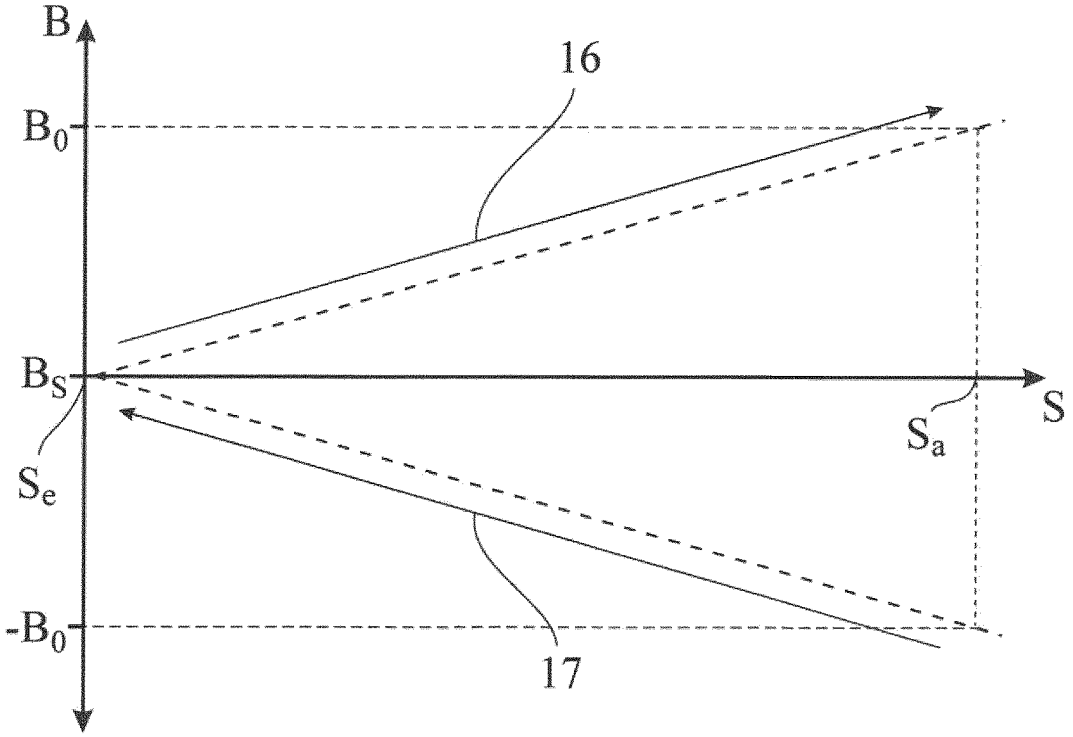
FIG. 3 shows the profile of the braking action of the brake assembly of the spindle drive according to FIG. 1 in relation to the position of the spindle drive.
Figure 4:
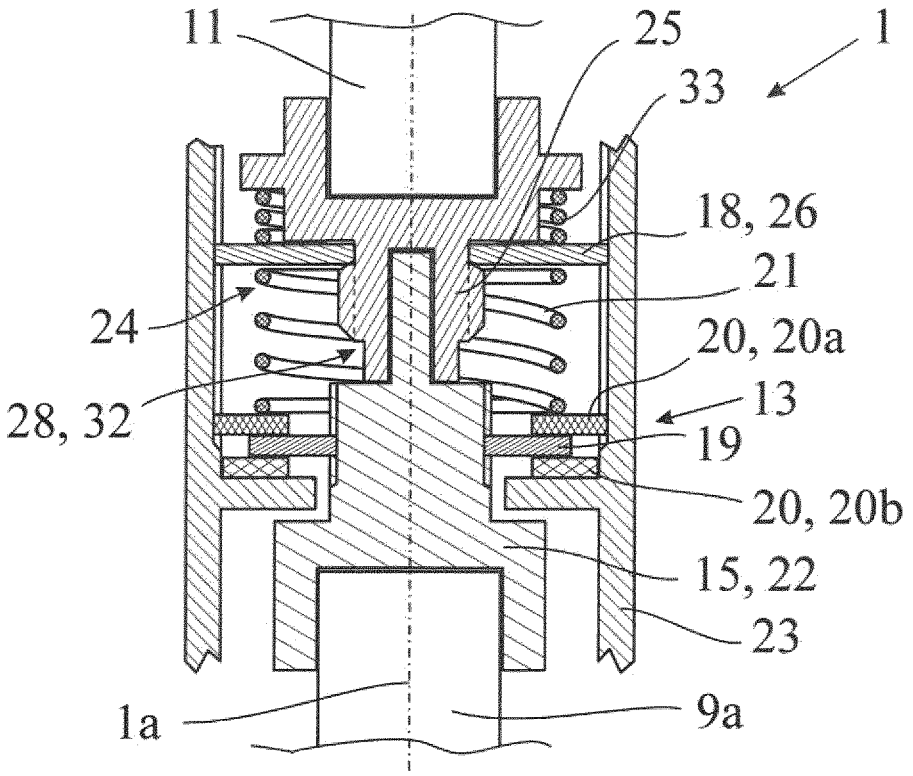
FIG. 4 shows a further embodiment of the spindle drive according to FIG. 1 as a view according to FIG. 2.
Figure 4:
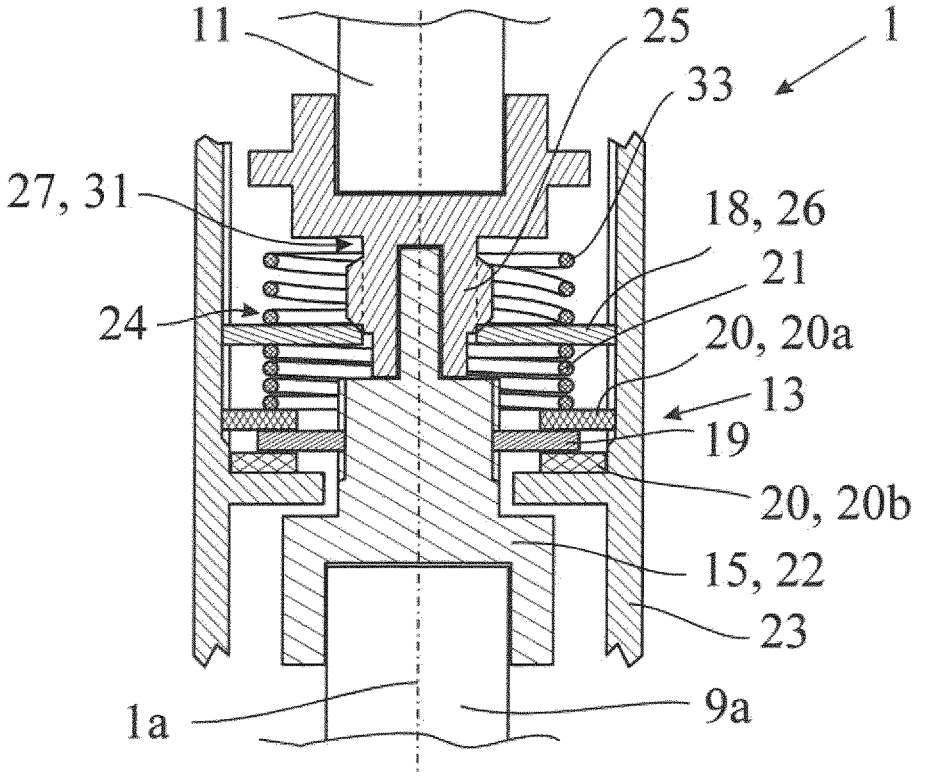
Figure 5:
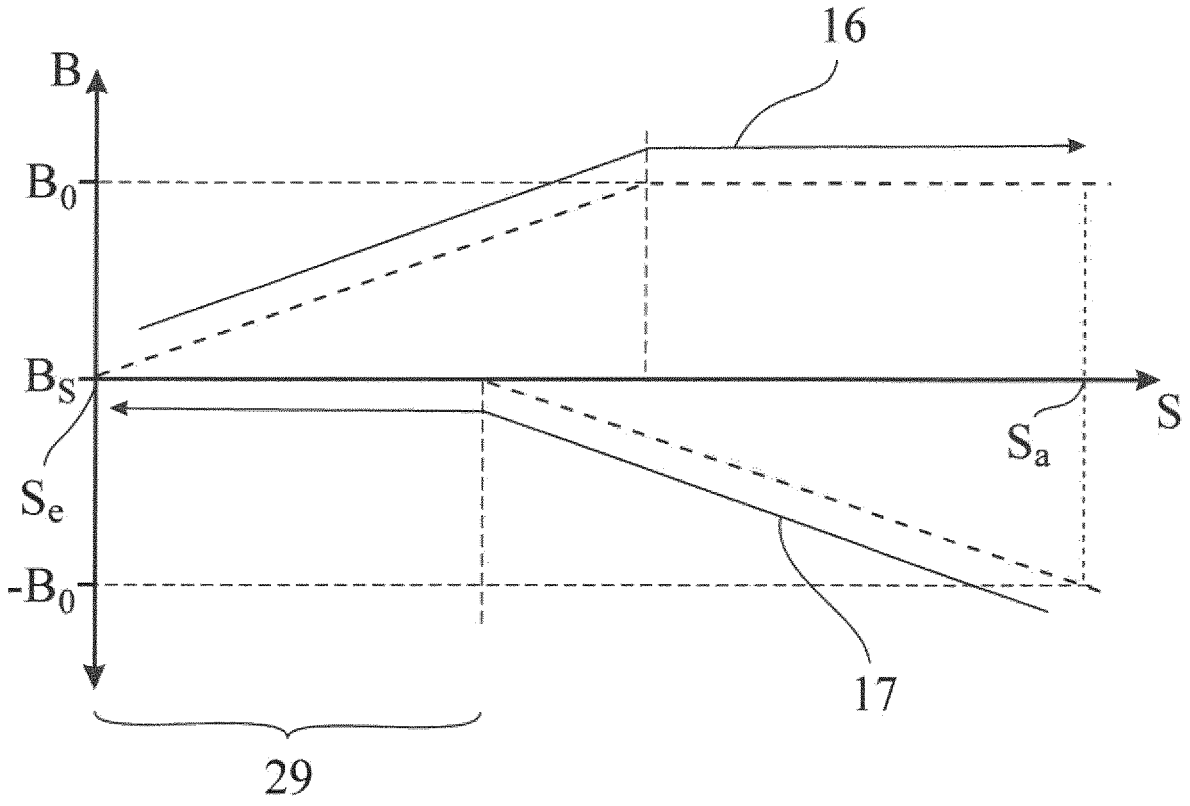
FIG. 5 shows the profile of the braking action of the brake assembly of the spindle drive according to FIG. 4 in relation to the adjustment of the spindle drive.

FIGS. 3 and 5 firstly show the braking action B as a dotted line as a function of the position S of the spindle drive 1 for embodiments according to FIGS. 2 and 4. In this case, braking actions B in the opposite direction result between an opening movement 16 and a closing movement 17 of the tailgate 2 due to the reverse movement. The assignment of the respective braking action B to the respective movement of the tailgate 2 is indicated in FIGS. 3 and 5 using arrows 16, 17.

In both exemplary embodiments depicted, the brake assembly 13 constantly brakes the drive train 8 of the spindle drive 1. However, it is also fundamentally conceivable for the brake assembly 13 to be uncoupled from the drive train 8.

Furthermore, it can be inferred from the representations according to FIGS. 3 and 5 that the braking action B rises or falls with the adjustment of the spindle drive 1, in this case linearly, at least over a portion of the adjustment range of the spindle drive 1. In this respect it is provided in various exemplary embodiments that the braking action B rises at least over a portion of the adjustment range of the spindle drive 1 with the motorized opening of the tailgate 2 and falls at least over a portion of the adjustment range of the spindle drive 1 with the motorized closing of the tailgate 2. This is also appropriate, since the braking action B is primarily required to hold the tailgate 2 in the open position or in an intermediate position, while the braking action B of the brake assembly 13 has a more disruptive influence in the region of the closing position of the tailgate 2.

In principle, the profile of the braking action B during the opening movement 16 may be provided symmetrically to the profile of the braking action B during the closing movement 17, as is shown in FIG. 3. It may also be advantageous, however, for the corresponding profiles of the braking action B of the brake assembly 13 to be designed asymmetrically to one another, as is shown in FIG. 5.

FIGS. 3 and 5 show that the rate of increase or rate of reduction of the braking action B relative to the adjustment of the spindle drive 1 there is constantly identical for both adjustment directions. This means, in the mathematical sense, that the gradient of the profile of the braking action B is constantly identical in terms of magnitude, insofar as in the respective portion of the adjustment range of the spindle drive 1 there is in fact any increase in the braking action.

With the embodiment according to FIG. 5, it is true that the braking action B remains constant over at least a portion of the adjustment range of the spindle drive 1. This is provided, particularly in the region of a drive end position, especially in the region of the drive end position corresponding to the open position of the tailgate 2.

The design according to FIG. 5 shows a special feature to this extent, in that the profile of the braking action B during an opening movement 16 with a subsequent closing movement 17 is hysteresis-like. This means that the rise or fall of the braking action B differs depending on the preceding adjustment of the spindle drive 1 or on the adjustment direction. The implementation in this respect is explained in detail below.

The brake assemblies 13 depicted in FIGS. 2 and 4 are each fitted with an actuating element 18, wherein the braking action B of the brake assembly 13 can be set by an adjustment of the actuating element 18. The actuating element 18 for this purpose is coupled with the drive worm gear 10, in this case with the spindle 11 of the drive worm gear 10, in such a manner that the braking action B rises or falls with the adjustment of the spindle drive 1 at least over a portion of the adjustment range of the spindle drive 1. The coupling of the actuating element 18 with the drive worm gear 10 will be explained below.

In this case, the brake assembly 13 is fitted with a brake element 19 and a brake counter-element 20, wherein the brake element 19 and brake counter-element 20 are preloaded in respect of one another to generate the braking action B via a brake spring assembly 21 and are thereby in frictional engagement with one another.

In this case it is further provided that the actuating element 18 is coupled with the brake spring assembly 21, namely in such a manner that an adjustment of the actuating element 18 accompanies a change in the spring preloading. This results in each case from an integrated view of FIGS. 2*a* and 2*b* and also of FIGS. 4*a* and 4*b*.

Figure 8:
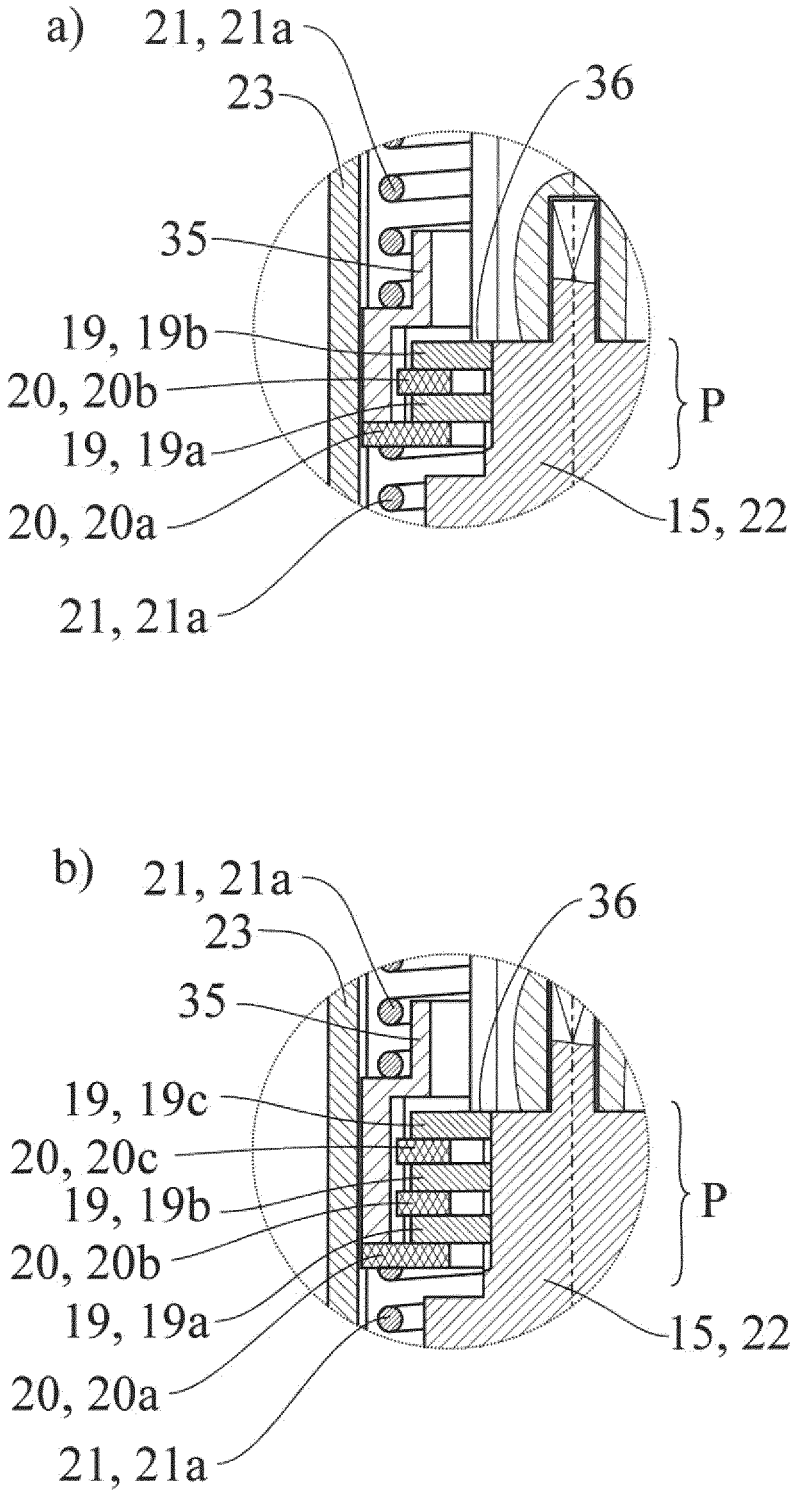
FIG. 8 shows the brake package of the spindle drive according to FIG. 7 *a*) with two brake elements and *b*) with three brake elements.

It is quite generally true that the brake element 19 and the brake counter-element 20 are integral parts of a brake package P which is preloaded via the brake spring assembly 21 to generate the braking action. The brake package P can have at least two brake elements 19*a-c* and/or at least two brake counter-elements 20*a-c*. In this case, the brake elements 19*a-c* and the brake counter-elements 20*a-c* are axially coated so that the preloading to generate the braking action B produces a frictional engagement between each adjacent brake element 19*a-c* and brake counter-element 20*a-c*. FIG. 8*a* shows by way of example a brake package P made up of two brake elements 19*a-c* and two brake counter-elements 20*a-c*, while FIG. 8*b* shows by way of example a brake package P made up of three brake elements 19*a-c* and three brake counter-elements 20*a-c*.

In order to generate the desired braking action B, the brake element 19 is coupled with the component 22 of the drive train 8 to be braked, in this case with a drive shaft of the drive train 8. The exemplary embodiment depicted in the case of this coupling is a non-rotational coupling between the brake element 19 and the component 22. In this case, the brake element 19 is at least slightly displaceable along the longitudinal axis 1*a* of the spindle drive 1, so that the brake element 19, as shown in the drawing, can be aligned between an upper brake counter-element 20*a* and a lower brake counter-element 20*b*.

The brake counter-element 20, in this case the upper brake counter-element 20*a*, and the lower brake counter-element 20*b*, is/are coupled with a housing component 23. In this case, the lower brake counter-element 20*b* is connected to the housing component 23, while the upper brake counter-element 20*a* is non-rotational relative to the longitudinal axis 1*a*, but is coupled in a longitudinally displaceable manner with the housing component 23.

What is interesting is that in addition to the drive worm gear 10, a control worm gear 24 is provided which has a spindle 25 with an external spindle thread and a spindle nut 26 with an internal spindle thread which is in screw engagement with the external spindle thread. In this case, the actuating element 18 is coupled via the control worm gear 24 with the drive worm gear 10, in that the spindle 11 of the drive worm gear 10 can be coupled with, in this case connected to, the spindle 25 of the control worm gear 24. This is shown in FIGS. 2 and 4, in which in the respective representation the spindle 11 of the drive worm gear 10 projects upwards and the drive shaft 9*a* of the motor unit 9 downwards.

In various embodiments, the actuating element 18 is coupled with the spindle nut 26 of the control worm gear 24. In this case it is even the case that the actuating element 18 forms the spindle nut 26 of the control worm gear 24. This means that a rotation of the spindle 11 of the drive worm gear 10 brings with it a corresponding adjustment of the actuating element 18, at least over a portion of the adjustment range of the spindle drive 1. Specifically, it is the case that an adjustment of the spindle drive 1 between the two drive end positions accompanies an adjustment of the actuating element 18 between two actuating element end positions.

For the first exemplary embodiment, FIGS. 2*a* and 2*b* show the actuating element 18 in the two actuating element end positions, wherein FIG. 2*a* corresponds to the closed position of the tailgate 2 and FIG. 2*b* to the open position of the tailgate 2. An overall view of FIGS. 2*a* and 2*b* shows that the actuating element 18 is always engaged with the spindle 25 of the control worm gear 24 during the adjustment of the tailgate 2 between the closed position and the open position. This produces the performance of the braking action B of the brake assembly 13 shown in FIG. 3 results.

A different method of operation results in the exemplary embodiment according to FIG. 4. The control worm gear 24 is fitted in this respect with at least one freewheel, in this case with two freewheels 27, 28. An adjustment of the spindle drive 1 into the drive end positions results in the control worm gear 24 freewheeling when a freewheel end region upstream of the respective drive end position is passed through. The freewheel end regions are depicted in FIG. 5 using the reference numbers 29, 30. "Freewheeling of the control worm gear" in the present case means that an adjustment of the control worm gear 24, in particular of the spindle 25 of the control worm gear 24, does not trigger an adjustment of the actuating element 18 and therefore a change in the braking action B. This can be seen most clearly from the depiction according to FIG. 5.

The freewheels 27, 28 are formed in this case in that the spindle 25 of the control worm gear 24 for each freewheel 27, 28 has a corresponding cutout 31, 32 in the external spindle thread of the spindle 25 of the control worm gear 24.

In addition, it can be provided that the spindle 25 of the control worm gear 24 has fewer threads than the spindle 11 of the drive worm gear 10. Insofar as the spindle 11 of the drive screw worm 10, as shown in the drawing, is coupled with, in particular connected to, the spindle 25 of the control worm gear 24, this means with a suitable design that an adjustment of the spindle drive 1 between the two drive end positions accompanies a passing through of the two freewheel end regions 29, 30. The fact that when a freewheel end region 29, 30 is reached, the spindle nut 26 of the control worm gear 24 comes out of engagement with the spindle 25 thereof, means that the braking action B remains constant in each case during the passing through of the freewheel end regions 29, 30.

In order to ensure that even with a motorized opening of the tailgate 2 from the closed position, a "threading" of the spindle nut 26 onto the spindle 25 of the control worm gear 24 takes place safely, a further spring assembly 33 is provided which is coupled with the actuating element 18 in such a manner that the spring assembly 33 constantly preloads the spindle nut 26 of the control worm gear 24 in engagement with the spindle 25 thereof. This can be seen most clearly from the depiction in FIG. 4*a*. FIG. 4*b* shows that the same function is assigned to the brake spring assembly 21 with motorized closure of the tailgate 2 from the open position.

It should also be pointed out that FIG. 5 used a dotted line to depict the profile of the braking action B of the brake assembly 13 of the spindle drive 1 according to FIG. 4 in a further embodiment, in which the gap S between the actuating element 18 and the brake spring assembly 21 has been enlarged. The gap S means that a motorized closure from the closing position is initially accompanied by an adjustment portion of constant or diminishing braking action. This is due to the fact that in this portion the brake spring assembly 21 is still disengaged from the actuating element 18.

The brake assembly 13 as proposed may be arranged at completely different points of the drive train 8 of the spindle drive 1. For example, it is conceivable for the brake assembly 13 to be integrated in an overload coupling connected in the drive train 8. Alternatively, it may be provided that the brake arrangement 13 is integrated in the spindle nut 12 of the drive worm screw 10.

Figure 6:
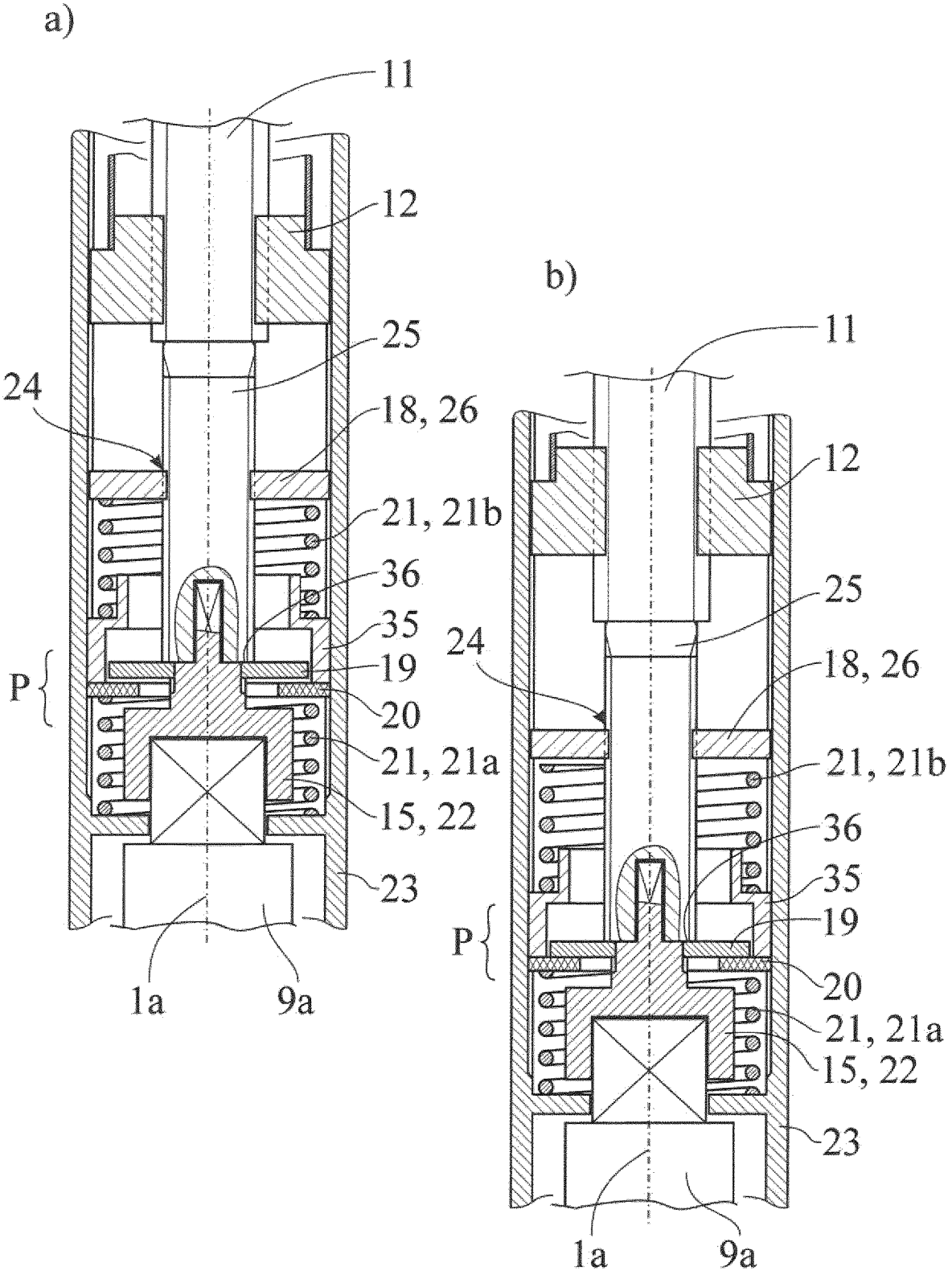
FIG. 6 shows a further embodiment of the spindle drive according to FIG. 1 as a view according to FIG. 2, a) with the tailgate in the closed position and b) with the tailgate in a slightly open position.
Figure 7:
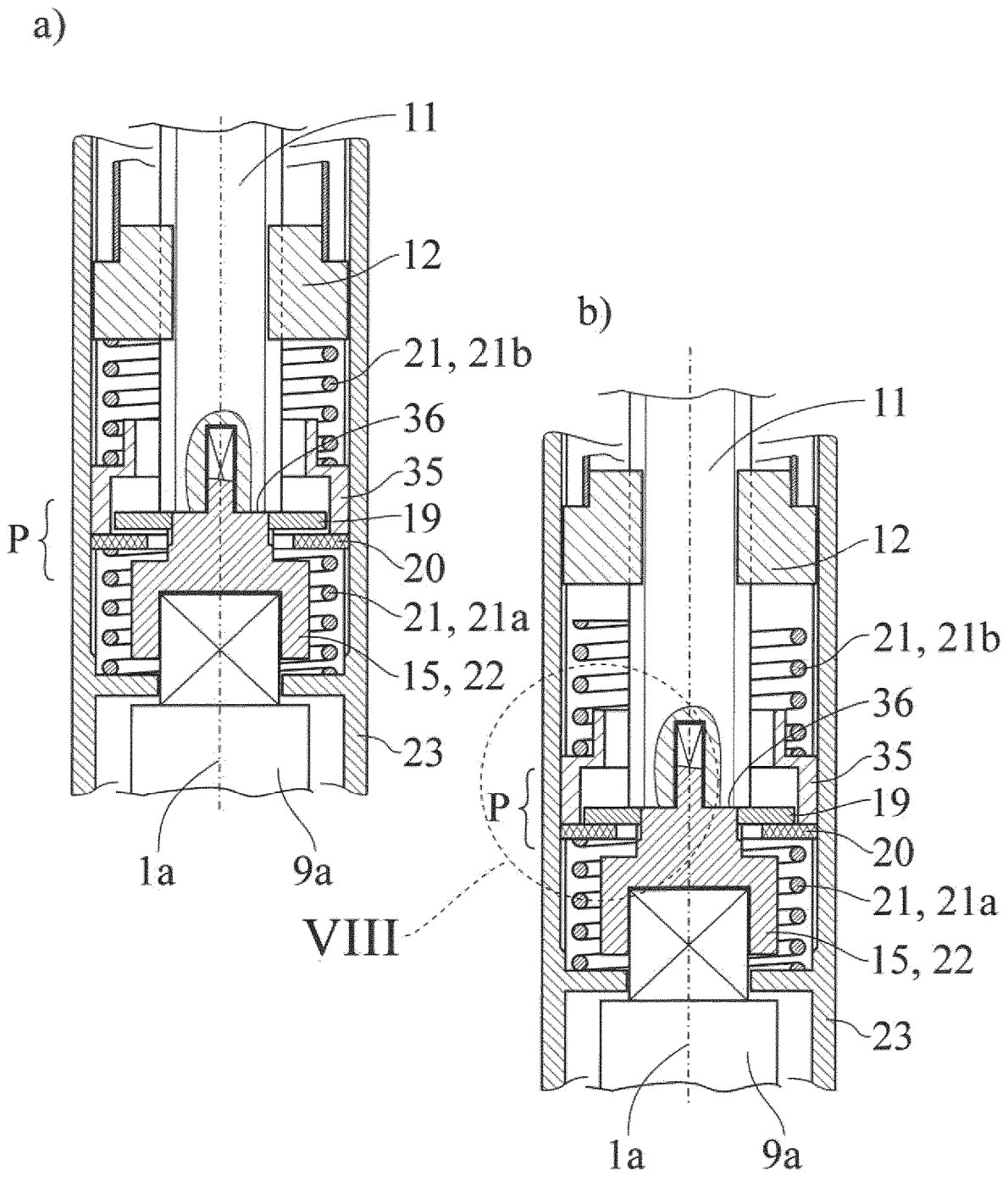
FIG. 7 shows a further embodiment of the spindle drive according to FIG. 1 as a view according to FIG. 6.

FIGS. 6 and 7 show two further embodiments in which the brake spring assembly 21 has a first spring component 21*a* and a second spring component 21*b* which work against one another, at least over a portion of the adjustment range of the spindle drive 1, when it comes to generating the preloading of the brake packet P. What is meant by this is that the spring forces of the two spring components 21*a*, 21*b* more or less offset one another when it comes to generating the preloading of the brake package P depending on the adjustment of the spindle drive 1, as will be shown. The spring components 21*a* and 21*b* in this case are helical spring elements which are each oriented coaxially to the longitudinal axis 1*a* of the spindle drive 1. In principle, each spring component 21*a*, 21*b* may also have a plurality of helical spring elements. The spring characteristics of the two spring components 21*a*, 21*b*, in particular the effective spring characteristic lines in each case, are in this case identical to one another.

The spring components 21*a*, 21*b* in the exemplary embodiments which are shown in FIGS. 6 and 7 and are coupled directly or indirectly with the brake package P, in such a manner that at least over a portion of the adjustment range of the spindle drive 1, the spring force of the first spring component 21*a* helps to preload the brake package P and the spring force of the second spring component 21*b* reduces the preloading of the brake package P. Specifically, it is true that the magnitude of the preloading of the brake package P results from the difference between the magnitudes of the spring forces of the two spring components 21*a*, 21*b*. For this purpose, the two spring components 21*a*, 21*b* are arranged along the longitudinal axis 1*a* of the spindle drive 1 on opposite sides of the brake package P.

At least part of the brake package P can be displaceable at least slightly axially, so along the longitudinal axis 1*a* of the spindle drive 1. In the case of the exemplary embodiments depicted and the entire brake package P in each case is at least slightly axially displaceable. In this case the brake elements 19 are each coupled in a non-rotational manner with the spindle 11 of the drive worm gear 10, while the brake counter-elements 20 are each coupled in a non-rotational manner with the housing component 23.

So that they work against one another in the above sense, the spring components 21*a*, 21*b* of the brake spring assembly 21 may in principle be directly engaged with one another. In this case, it is however true that both spring components 21*a*, 21*b* of the brake spring assembly 21 work against one another on one and the same element of the brake spring assembly 21, in this case on the brake counter-element 20 or on the brake counter-element 20*a*. In order to achieve this, at least part of the brake package P is arranged in a bell body 35 which is in engagement with, or can be brought into engagement with, a brake counter-element 20 of the brake package P at one end and with the second spring component 21*b* at the other end. This may, in principle, also be provided for a brake element 19.

FIGS. 6 and 7 show that an axial stop 36, relative to the longitudinal axis 1*a*, is provided for the axially displaceable brake package P and that the first spring component 21*a* exerts a spring force on the brake package P in the direction of the axial stop 36. The second spring component 21*b*, on the other hand, exerts a spring force on the brake package P against the direction of the axial stop 36. The axial stop 36 may, in principle, also assume the function of a brake element 19 or a brake counter-element 20 which is fixed on the housing component 23 or on the spindle 11.

Further, the spring force of the first spring component 21*a* acting on the brake package P is constant, irrespective of the adjustment of the spindle drive 1, at least over a portion of the adjustment range of the spindle drive 1. This is the case when the influence of the second spring component 21*b* on the resulting preloading of the brake package P is negligibly small. In the situation shown in FIG. 7*b*, this is the case since the second spring component 21*b* is disengaged from the brake package P there.

With the exemplary embodiment shown in FIG. 6, a spring component 21*a*, 21*b* of the brake spring assembly 21, in particular the second spring component 21*b*, for adjustment of the braking action is coupled with the actuating element 18 of the control worm gear 24. This means that the spring force of the second spring component 21*b* works against the spring force of the second spring component 21*a*, in this case via the bell body 35, depending on the adjustment of the spindle drive 1. In the situation shown in FIG. 6*a*, the tailgate 2 is in the closed position in which the actuating element 18 is in a lower position in FIG. 6. This means that the second spring component 21*b* acts with a high spring force on the brake counter-element 20, so that the brake counter-element 20 is triggered by the brake element 19 and the braking action is cancelled. With the motorized opening of the tailgate 2, the actuating element 18 reaches the position shown in FIG. 6*b*, which reduces the spring force of the second spring component 21*b*, so that due to the spring force of the first spring component 21*a*, a preloading of the brake package P is generated. To be precise, this preloading, as indicated above, results from the difference between the magnitudes of the spring forces of the two spring components 21*a*, 21*b*.

A fundamentally similar method of operation during production of the braking action is shown by the arrangement according to FIG. 7. In this case, a spring component 21*a*, 21*b* of the brake spring assembly 21, in particular the second spring component 21*b*, is coupled for adjustment of the braking action with the spindle nut 12 of the drive worm gear 10. In this case, it can be true that the brake spring assembly 21 is in engagement with, or becomes engaged with, the spindle nut 12 of the drive worm gear 10, depending on the adjustment of the spindle drive 1 for adjusting the braking action. The spindle nut 12 creates the actuating element referred to above to this extent, so that a separate control worm gear can be dispensed with.

According to further teaching, the tailgate assembly 34 of the motor vehicle is disclosed as such with the tailgate 2 and with a spindle drive 1 as proposed, which spindle drive is used for the motorized adjustment of the tailgate 2. Reference may be made to all comments on the spindle drive 1 as proposed.

The invention claimed is:

1. A spindle drive for a tailgate of a motor vehicle configured to be adjusted between two drive end positions comprising a retracted position and an extended position, the spindle drive comprising:

two drive connections for diverting drive movements, a drive train between the two drive connections, the drive train comprising a motor unit and a drive gear, wherein the drive gear is located downstream of the motor unit, such that the motor unit drives the drive gear, the drive gear comprising:

a spindle with an external spindle thread, and a spindle nut with an internal spindle nut thread, wherein the internal spindle nut thread is in screw engagement with the external spindle thread, and a brake assembly configured to apply a braking force to at least a part of the drive train, wherein the brake force is adjustable and the brake assembly is coupled with a component of the drive train for the adjustment of the braking force, wherein the braking force increases or decreases with the adjustment of the spindle drive over at least a portion of an adjustment range of the spindle drive, and wherein the braking force depends on a position of the spindle drive.

2. The spindle drive as claimed in claim 1, wherein the brake assembly constantly brakes the drive train.

3. The spindle drive as claimed in claim 1, wherein the braking force increases at least over a portion of the adjustment range of the spindle drive with a motorized opening of the tailgate and decreases at least over a portion of the adjustment range of the spindle drive with a motorized closing of the tailgate.

4. The spindle drive as claimed in claim 3, wherein the rate of increase and the rate of decrease of the braking force relative to the adjustment of the spindle drive are identical for both adjustment directions of the spindle drive or wherein an increase and decrease of the braking force differs depending on a preceding adjustment of the spindle drive and on an adjustment direction.

5. The spindle drive as claimed in claim 1, wherein the brake assembly has an actuating element, wherein the braking force of the brake assembly can be set by an adjustment of the actuating element and the actuating element is coupled with the drive gear in such a manner that the braking force increases or decreases with an adjustment of the spindle drive at least over a portion of the adjustment range of the spindle drive.

6. The spindle drive as claimed in claim 5, wherein the brake assembly comprises a brake element and a brake counter-element which are preloaded against each other to generate the braking force via a brake spring assembly and are thereby in frictional engagement with each other.

7. The spindle drive as claimed in claim 6, wherein the brake element and the brake counter-element are part of a brake element assembly, wherein the brake element assembly is preloaded via the brake spring assembly to generate the braking force, wherein the brake element assembly has at least two brake elements and at least two brake counter-elements.

8. The spindle drive as claimed in claim 6, wherein the actuating element is coupled with the brake spring assembly in such a manner that an adjustment of the actuating element accompanies a change in the preloading of the brake element and the brake counter-element via the brake spring assembly.

9. The spindle drive as claimed in claim 6, wherein the brake element is coupled with a component of the drive train.

10. The spindle drive as claimed in claim 6, wherein the brake counter-element is coupled with a housing component of the spindle drive.

11. The spindle drive as claimed in claim 6, wherein a control gear is provided which has a spindle with an external spindle thread and a spindle nut with an internal spindle nut thread which is in screw engagement with the external spindle thread and wherein the actuating element is coupled with the drive gear via the control gear, wherein the spindle of the drive gear is coupled with the spindle of the control gear, and wherein the actuating element is coupled with the spindle nut of the control gear or forms the spindle nut of the control gear.

12. The spindle drive as claimed in claim 11, wherein the control gear comprises at least one freewheel mechanism configured in such a manner that an adjustment of the spindle drive into at least one drive end position results in the control gear freewheeling when a freewheel end region upstream of the respective drive end position is passed through or wherein the control gear comprises two freewheel mechanisms configured in such a manner that an adjustment of the spindle drive into the two drive end positions results in each case in the control gear freewheeling when a freewheel end region upstream of the respective drive end position is passed through.

13. The spindle drive as claimed in claim 12, wherein at least one of the freewheel mechanisms is formed such that when a freewheel end region is reached, the spindle nut of the control gear comes out of engagement with the spindle thereof, wherein the spindle of the control gear has fewer threads than the spindle of the drive gear.

14. The spindle drive as claimed in claim 11, wherein a spring assembly of the brake assembly is coupled with the actuating element in such a manner that the spring assembly constantly preloads the spindle nut of the control gear into engagement with the spindle of the control gear.

15. The spindle drive as claimed in claim 11, wherein the brake spring assembly has a first spring component and a second spring component which act against one another, at least over a portion of the adjustment range of the spindle drive, to generate the preloading of a brake element assembly, wherein a spring force of the first spring component helps to preload the brake element assembly at least over a portion of the adjustment range of the spindle drive and a spring force of the second spring component reduces the preloading of the brake element assembly.

16. The spindle drive as claimed in claim 15, wherein a magnitude of the preloading of the brake element assembly results from a difference between the magnitudes of the spring forces of the two spring components.

17. The spindle drive as claimed in claim 15, wherein the two spring components are arranged along the longitudinal axis of the spindle drive on opposite sides of the brake element assembly.

18. The spindle drive as claimed in claim 15, wherein both spring components of the brake spring assembly apply a force, in opposite directions, on the same element of the brake spring assembly.

19. The spindle drive as claimed in claim 15, wherein an axial stop is provided for the brake element assembly and the first spring component exerts a spring force on the brake element assembly in a direction of the axial stop, wherein the second spring component exerts a spring force on the brake element assembly in the opposite direction.

20. The spindle drive as claimed in claim 15, wherein the spring force of the first spring component acting on the brake element assembly is constant, irrespective of the adjustment of the spindle drive, at least over a portion of the adjustment range of the spindle drive.

21. The spindle drive as claimed in claim 15, wherein the first spring component or the second spring component of the brake spring assembly, for adjustment of the braking force is coupled with the actuating element, wherein the brake spring assembly is in engagement with, or becomes engaged with, the actuating element depending on the adjustment of the spindle drive for setting the braking force.

22. The spindle drive as claimed in claim 15, wherein the first spring component or the second spring component of the brake spring assembly, for adjustment of the braking force is coupled with the spindle nut of the control gear, wherein the brake spring assembly is in engagement with, or becomes engaged with the spindle nut of the drive gear depending on the adjustment of the spindle drive for setting the braking force.

23. The spindle drive as claimed in claim 5, wherein an adjustment of the spindle drive between the two drive end positions accompanies an adjustment of the actuating element between two actuating element end positions.

24. A tailgate assembly of a motor vehicle with a tailgate and with the spindle drive for the motorized adjustment of the tailgate as claimed in claim 1.

* * * * *